US009372455B2

(12) United States Patent
Yashiro et al.

(10) Patent No.: US 9,372,455 B2
(45) Date of Patent: Jun. 21, 2016

(54) IMAGE HEATING APPARATUS

(71) Applicant: CANON KABUSHIKI KAISHA, Tokyo (JP)

(72) Inventors: Ryo Yashiro, Tokyo (JP); Hidekazu Maruta, Abiko (JP); Masayuki Tamaki, Abiko (JP); Ryo Suzuki, Kashiwa (JP); Mitsuru Hasegawa, Tsukubamirai (JP); Rikiya Takemasa, Kashiwa (JP); Koichi Kakubari, Toride (JP); Shigeru Hirano, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/875,498

(22) Filed: Oct. 5, 2015

(65) Prior Publication Data

US 2016/0098002 A1 Apr. 7, 2016

(30) Foreign Application Priority Data

Oct. 7, 2014 (JP) ..... 2014-206645
Oct. 15, 2014 (JP) ..... 2014-211196

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS

2011/0299901 A1* 12/2011 Yonekawa ..... G03G 15/2053 399/329
2014/0318931 A1* 10/2014 Takematsu ..... B65G 15/60 198/837

FOREIGN PATENT DOCUMENTS

| | | | |
|---|---|---|---|
| JP | 2002-246151 | A | 8/2002 |
| JP | 2009-092785 | A | 4/2009 |
| JP | 2013-142779 | A | 7/2013 |
| JP | 2013-186365 | A | 9/2013 |
| JP | 2014-232302 | A | 12/2014 |

* cited by examiner

*Primary Examiner* — G. M. Hyder
(74) *Attorney, Agent, or Firm* — Canon USA Inc. IP Division

(57) ABSTRACT

An image heating apparatus includes a heating belt having a heat generating layer configured to generate heat by energization, a pressing roller configured to abut on an outer peripheral surface of the heating belt to form a nip portion, a pressing mechanism configured to press the heating belt against the pressing roller, an outer ring electrically connected to the heating belt in an end portion of the heating belt, a power feed member configured to abut on the outer ring to feed power to the outer ring, and an inner ring configured to clamp the end portion of the heating belt between the inner ring and the outer ring. A chamfered portion of the inner ring is chamfered.

14 Claims, 10 Drawing Sheets

IMAGE HEATING APPARATUS

BACKGROUND OF THE INVENTION

1. Field of the Invention

The present invention relates to an image heating apparatus that heats an image on a sheet. The image heating apparatus is used in image forming apparatuses such as a copying machine, a printer, a facsimile, and a multifunction apparatus having some of functions of these machines.

2. Description of the Related Art

In an image forming apparatus, a toner image (developing-agent image) is formed on a sheet and is fixed on the sheet by being heated and pressed with a fixing device serving as an image heating apparatus. From the recent viewpoint of energy saving, Japanese Patent Laid-Open No. 2009-92785 proposes a fixing device using a heating belt having a heating resistor layer as a fixing device that provides high heat transfer efficiency and a quick temperature rise. Since the heating belt itself generates heat by energization of the heating resistor layer in this method, heat of the heating belt can be efficiently transferred to the sheet.

In the heating belt adopted in the fixing device described in Japanese Patent Laid-Open No. 2009-92785, the heating resistor layer is stacked on a cylindrical insulating base material and electrode layers are stacked at both widthwise ends of the heating resistor layer. Power feed members formed by carbon chips or the like are pressed against the electrode layers of the heating belt. The power feed members feed power to the electrode layers of the rotating heating belt while sliding on the electrode layers. When current thus flows to the heating resistor layer of the heating belt, the heating resistor layer generates heat, and the heating belt is entirely heated.

Since the power feed members and the electrode layers slide on each other in this fixing device, the electrode layers wear down along with the use of the fixing device. The progress of wear of the electrode layers shortens the life of the heating belt.

To overcome this problem, in a fixing device disclosed in Japanese Patent Laid-Open No. 2014-232302, electrode layers are reinforced by attaching ring-shaped members to end portions of a heating belt. Specifically, in this fixing device, ring-shaped members disposed along an outer periphery of the heating belt and ring-shaped members disposed along an inner periphery of the heating belt clamp the heating belt therebetween to fix the ring-shaped members to the heating belt. At this time, the outer ring-shaped members are electrically connected to the electrode layers. This allows power feed members to feed power to the electrode layers via the ring-shaped members.

However, when the ring-shaped members are attached to the heating belt, the heating belt sometimes wears down according to the structure of the ring-shaped members. The cause of occurrence of wear of the belt will be described with reference to FIGS. 11A and 11B. FIG. 11A schematically illustrates the structure of a fixing device in which ring-shaped members are attached to one longitudinal end portion of the belt. FIG. 11B shows cross-sectional views taken along A-A and B-B of FIG. 11A.

As illustrated in FIG. 11A, in the fixing device, a nip portion N is formed by abutment of the belt and a pressing roller. For this reason, as illustrated in the B-B cross section of FIG. 11B, the cross section of a longitudinal center portion of the belt is locally flat at the nip portion N. On the other hand, in the fixing device, as illustrated in FIG. 11A, front and back sides of the longitudinal end portion of the belt are clamped between an inner ring-shaped member and an outer ring-shaped member. For this reason, the cross section of the longitudinal end portion of the belt is kept circular, as illustrated in the A-A cross section of FIG. 11B. At this time, the height of the belt on the side of the nip portion N is different by a height H between the longitudinal center portion and the longitudinal end portion of the belt.

As illustrated in FIG. 11A, in a section D of the belt in the longitudinal direction, the belt is deformed to connect the A-A cross section and the B-B cross section. Since an inner surface of the belt strongly abuts on a corner portion of the inner ring-shaped member in such a state, local stress concentration occurs. In a portion of the belt where stress concentrates, wear is promoted and the strength decreases, which shortens the life of the belt. Therefore, in the fixing device in which the belt for generating heat by energization is reinforced by the ring-shaped members, the life of the belt is to be suppressed from being shortened by the abutment between the corner portion of the inner ring-shaped member and the inner surface of the belt.

SUMMARY OF THE INVENTION

The present invention provides an image heating apparatus in which the decrease in life of a belt is suppressed.

An image heating apparatus according to an aspect of the present invention includes an endless and flexible belt configured to heat an image on a sheet and having a heat generating layer configured to generate heat by energization, an abutting member configured to abut on an outer peripheral surface of the belt so that a nip portion is formed between the belt and the abutting member to nip and convey the sheet, a pressing mechanism configured to press the belt and the abutting member against each other, a first ring-shaped member provided along the outer peripheral surface of the belt at one end of the belt on an outer side of the nip portion in a longitudinal direction of the belt, the first ring-shaped member being electrically connected to the heat generating layer, a second ring-shaped member provided along an inner peripheral surface of the belt at the one end of the belt on the outer side of the nip portion in the longitudinal direction, the second ring-shaped member nipping the belt along with the first ring-shaped member, and a power feed member configured to abut on the first ring-shaped member to feed power to the first ring-shaped member. The second ring-shaped member has a chamfered portion in an end portion on a surface abutting on the belt and on a side of the nip portion in the longitudinal direction of the belt.

Further features of the present invention will become apparent from the following description of exemplary embodiments with reference to the attached drawings.

DESCRIPTION OF THE EMBODIMENTS

The present invention will be described in detail below in conjunction with an embodiment. In the following embodiment, a laser beam printer using an electrophotographic process is given as an example of an image forming apparatus. Hereinafter, this laser beam printer is referred to as a printer 1.

Embodiment

Image Forming Section

Figure 1:
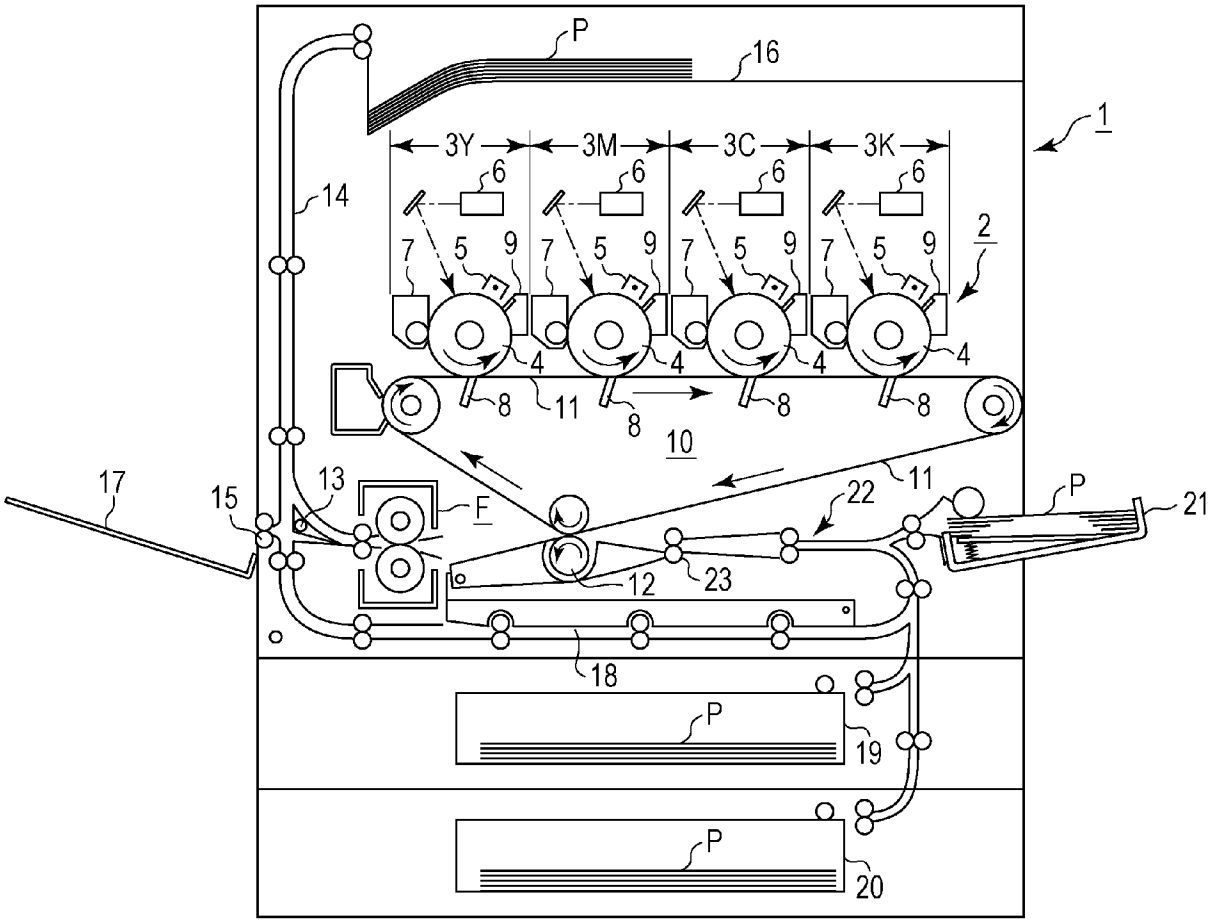
FIG. 1 illustrates the configuration of an image forming apparatus according to an embodiment.
Figure 2:
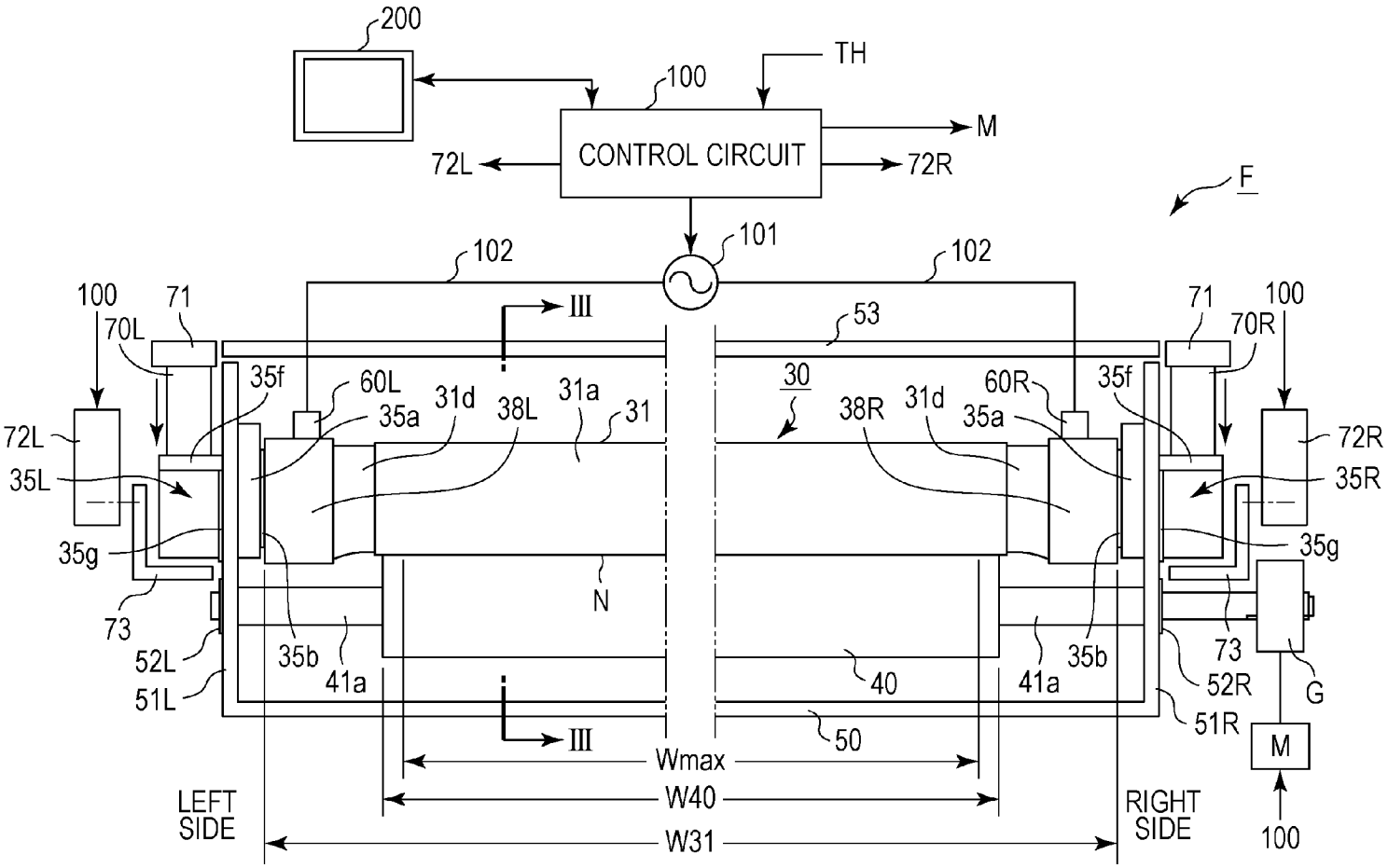
FIG. 2 is a front view of a fixing device in the embodiment.

FIG. 1 illustrates the configuration of a printer 1 serving as an image forming apparatus. FIG. 2 is a front view of a fixing device F. The printer 1 forms an image on a sheet P according to image information input from an external host apparatus 200 (FIG. 2) to a control circuit 100. The control circuit 100 includes a CPU that carries out computations relating to various control operations, and a nonvolatile medium, such as a ROM, that stores various programs. The ROM stores the programs, and the CPU reads out and executes the programs to carry out various control operations. As the control circuit 100, for example, an integrated circuit, such as an ASIC, may be used as long as it fulfills a similar function.

A sheet P is a medium on which an image is formed by the image forming apparatus, and is, for example, plain paper, thick paper, an envelope, a postcard, a seal, a resin sheet, an OHT sheet, or glossy paper having a standard size or a non-standard size.

An image forming section 2 includes four image forming stations 3Y, 3M, 3C, and 3K for forming toner images on a sheet P. Each of the image forming stations 3Y, 3M, 3C, and 3K includes a photoconductor 4 of a rotary drum type, a charging member 5, a laser scanner 6, a developing unit 7, a transfer member 8, and a photoconductor cleaner 9. The image forming stations 3Y, 3M, 3C, and 3K form toner images of yellow, magenta, cyan, and black, respectively.

The toner images formed by the image forming stations 3Y, 3M, 3C, and 3K are superimposed and primarily transferred as a synthetic toner image on an intermediate transfer belt 11.

On the other hand, sheets P placed in s sheet cassette 19 or 20 or a multiple sheet tray 21 are fed out one by one by a feeding mechanism (not illustrated), and a fed sheet P is sent into a registration roller pair 23. The registration roller pair 23 sends the sheet P between the intermediate transfer belt 11 and a secondary transfer roller 12 in synchronization with the synthetic toner image on the intermediate transfer belt 11. In this way, the synthetic toner image on the intermediate transfer belt 11 is transferred onto the sheet P. After that, the sheet P is sent toward a fixing device (image heating apparatus) F. The fixing device F fixes a toner image T on the sheet P by heat and pressure.

Fixing Device

Figure 3:
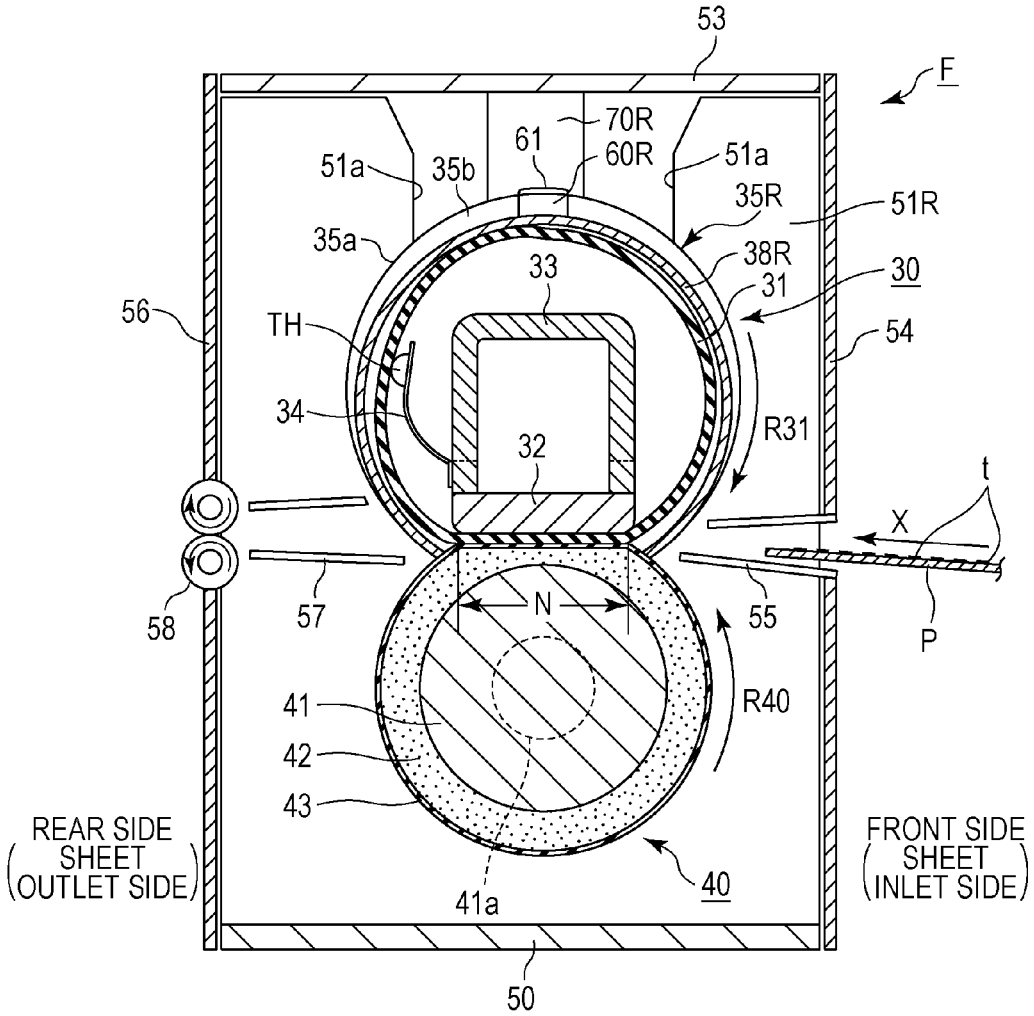
FIG. 3 is a view on arrow III-III of FIG. 2.
Figure 4:
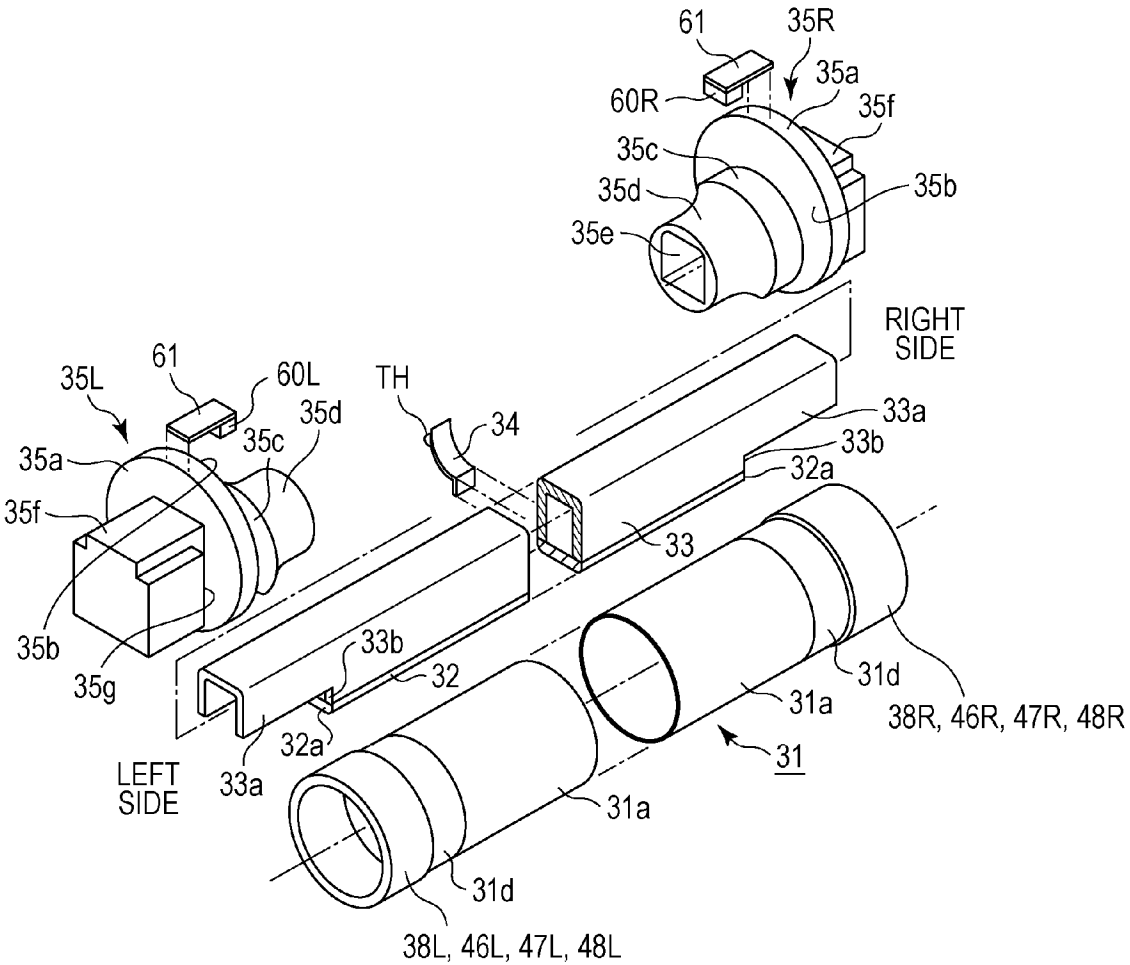
FIG. 4 is an exploded perspective view of a belt unit in the embodiment.

Next, the fixing device F will be described. FIG. 3 is a view on arrow III-III of FIG. 2. FIG. 4 is an exploded perspective view of a belt unit in the embodiment.

The fixing device F is an image heating apparatus that heats an image on a sheet by a belt unit 30 (hereinafter referred to as a unit 30) and a pressing roller (hereinafter referred to as a roller 40). The fixing device F is of a heating fixing belt type that uses a fixing belt 31 (hereinafter referred to as a belt 31) for generating heat by energization in the unit 30, and can efficiently transfer heat to a sheet P. The fixing device F is also of a pressing roller driving type (tensionless type) that rotates the unit 30 by the roller 40. For this reason, the fixing device F allows the unit 30 to have low heat capacity and is excellent in temperature rise performance at the start of fixing.

As illustrated in FIG. 2, the unit 30 and the roller 40 abut on each other to form a nip portion N therebetween. As illustrated in FIG. 3, when the roller 40 rotates in a direction of arrow R40 and the belt 31 rotates in a direction of arrow R31, a sheet P fed to the nip portion N is conveyed in a direction of arrow X. At this time, heat of the unit 30 is applied to the sheet P. Hence, a toner image T on the sheet P is fixed on the sheet P by being heated and pressed at the nip portion N. After passing through the nip portion N, the sheet P is separated from the belt 31 and is discharged. In the embodiment, the fixing process is performed as described above. The structure of the fixing device F will be described in detail below with reference to the drawings.

Here, in relation to the fixing device F and constituent elements thereof in the embodiment, the front side and the rear side refer to a surface viewed from a sheet inlet side of the device (FIG. 2) and a surface opposite therefrom (sheet outlet side), respectively. The left and the right refer to a left side (left side of FIG. 2, front side of FIG. 3) and a right side (right side of FIG. 2, rear side of FIG. 3), respectively, when viewed from the front side of the device. An upstream side and a downstream side refer to an upstream side and a downstream side in the sheet conveying direction, respectively. A longitudinal direction (widthwise direction) and a sheet width direction refer to directions substantially parallel to a direction (right-left direction, FIG. 2) orthogonal to the conveying direction of the sheet P on a conveying path surface. A widthwise direction refers to a direction substantially parallel to the conveying direction of the sheet P (right-left direction, FIG. 3).

As illustrated in FIG. 3, the unit 30 includes an endless belt 31 that generates heat by energization, a pressure pad 32 disposed inside the belt 31, and a pressure stay 33 serving as a pad holding member. As illustrated in FIG. 4, a power feed ring 38L and a power feed ring 38R serving as electrode portions are attached to one end and the other end of the belt 31 in the longitudinal direction, respectively. The belt 31 generates heat by the supply of power from the power feed rings 38L and 38R. Details of the belt 31 and the power feed rings 38L and 38R will be described later. The pressure pad 32 (nip pad: hereinafter referred to as a pad 32) is an adiabatic member that has a substantially rectangular cross section and is long in the right-left direction. The pressure stay 33 (hereinafter referred to as a stay 33) is a rigid member that has a downward-pointing angular-U-shaped cross section and is long in the right-left direction. The stay 33 is hard to warp even when high pressure is applied thereto, and can be formed by, for example, a profile of SUS304. The pad 32 and the stay 33 are arranged parallel to each other in the up-down direction, and the pad 32 is joined to leg portions of the stay 33. The pad 32 is a pressing member that is in sliding contact with an inner surface of the belt 31 at the nip portion N and that presses the belt 31 against the roller 40 from the inner side. Since the pad 32 functions as a guide for regulating the rotating track of the belt 31 near the nip portion N, it is required to have high heat resistance and high slidability with the inner surface of the belt 31.

As the material of the pad 32, a heat-resistant resin, such as a liquid crystal polymer, a ceramic material, or metal, such as SUS, can be used. A portion of the pad 32 corresponding to the nip portion N may be formed of a material having high slidability, such as SUS, and a guide portion may be formed of a heat-resistant resin having high workability such as a liquid crystal polymer. A sliding surface of the pad 32 on the belt 31 may be coated with a heat-resistant grease.

As illustrated in FIG. 4, a thermistor TH serving as a temperature sensor is disposed at almost the longitudinal center portion of the stay 33 with an elastic member 34, such as a leaf spring, being disposed therebetween. The belt 31 is loosely fitted on an assembly of the pad 32, the stay 33, the elastic member 34, and the thermistor TH from the outer side. At this time, the thermistor TH is made in elastic contact with the inner surface of the belt 31 with a predetermined pressing force at almost the longitudinal center portion of the belt 31 by elastic force of the elastic member 34.

The unit 30 has terminal members 35L and 35R attached to both end portions of the assembly. The terminal members 35L and 35R serve to regulate movement of the belt 31 in the widthwise direction and to guide inner peripheral surfaces of both end portions of the rotating belt 31. The terminal members 35L and 35R are mold from a heat-resistant and electrically insulating resin, and are symmetrically arranged in the end portions of the belt 31.

As illustrated in FIG. 4, the terminal members 35L and 35R have their respective flange portions 35*a* for receiving end faces of the power feed rings 38L and 38R on abutting faces 35*b* on the inner side.

Guide portions 35*c* project from the flange portions 35*a* toward the longitudinal center of the belt 31. The guide portions 35*c* are fitted in the power feed rings 38L and 38R to circularly guide the inner peripheral surfaces of the power feed rings 38L and 38R. Circular portions 35*d* further project from the guide portions 35*c* toward the longitudinal center of the belt 31. The circular portions 35*d* are substantially coaxial with the guide portion 35*c*, and have an outer diameter smaller than that of the guide portions 35*c*.

Holes 35*e* are provided inside the guide portions 35*c* and the small-outer-diameter circular portions 35*d* formed integrally with the guide portions 35*c* in the terminal members 35L and 35R. Right and left end portions 33*a* of the stay 33 are inserted in the holes 35*e*. Pressure-receiving block portions 35*f* project from the flange portions 35*a* toward the outer sides of the belt 31 in the longitudinal direction. The pressure-receiving block portions 35*f* have vertical groove portions 35*g* (FIGS. 2 and 3), and the terminal members 35L and 35R are engaged with side plates 51L and 51R, respectively.

Since the right and left end portions 33*a* of the stay 33 are inserted in the holes 35*e* of the terminal members 35L and 35R, the leg portions of the stay 33 are shorter than in the longitudinal center portion of the stay 33. The pad 32 is held by being joined to the leg portions of the stay 33 on the longitudinal center side.

Since the end portions 33*a* of the stay 33 are sufficiently fitted in and engaged with the holes 35*e*, the terminal members 35L and 35R are attached as a part of the unit 30. At this time, the guide portions 35*c* are fitted in radial inner portions of the power feed rings 38L and 38R in the unit 30.

As illustrated in FIG. 4, power feed members 60L and 60R are disposed at the tops of the flange portions 35*a* of the terminal members 35L and 35R, respectively, with leaf springs 61 of SUS or the like being disposed therebetween. The power feed members 60L and 60R elastically abut on outer faces of the power feed rings 38L and 38R at the left and right end portions of the belt 31 by spring force of the leaf springs 61. That is, the power feed members 60L and 60R are in electrically conductive contact with the outer faces of the left and right power feed rings 38L and 38R on the belt 31, respectively. Since a current of 12 A flows between the power feed members 60 and the power feed rings 38, the contact area between the power feed members 60 and the power feed rings 38 is preferably 10 $mm^2$ or more. In the embodiment, the power feed members 60 have a width of 6 mm in the longitudinal direction and a width of 2 mm in the widthwise direction.

In the embodiment, metal brushes are used as the power feed members 60L and 60R. Instead of the metal brushes, conductive members, such as metal blocks or carbon chips, may be used.

The roller 40 is a nip forming member that cooperates with the unit 30 (belt 31) to form the nip portion N therebetween. As illustrated in FIG. 3, the roller 40 is an elastic roller including an elastic layer 42 shaped like a roller concentrically and integrally with the outer periphery of a core metal 41 formed of a metallic material and an insulating layer 43 formed of a fluoroplastic material or the like and provided on an outer peripheral surface of the elastic layer 42. The material of the elastic layer 42 may be selected from, for example, heat-resistant rubber, such as silicone rubber or fluoro rubber, or silicone rubber foam. To stably convey the sheet P at the nip portion N without making any crease, the outer shape of the elastic layer 42 in the roller 40 of the embodiment is an inverted crown shape. At both right and left end portions of the core metal 41, small-diameter shaft portions 41*a* are provided concentrically and integrally with the core metal 41.

As illustrated in FIG. 2, the left and right small-diameter shaft portions 41*a* of the roller 40 are rotatably held between the left and right side plates 51L and 51R of a device frame 50 with bearing members 52L and 52R being disposed therebetween, respectively. A drive gear G is disposed concentrically and integrally with an end portion of the right small-diameter shaft portion 41*a*. Driving force of a motor M (driving source) controlled by the control circuit 100 is transmitted to the gear G via a power transmission mechanism (not illustrated). Thus, the roller 40 is rotationally driven as a driving rotating member at a predetermined peripheral velocity in the direction of arrow R40 (counterclockwise direction, FIG. 3).

On the other hand, the unit 30 is disposed on the upper side of the roller 40 and substantially parallel to the roller 40 so that the pad 32 abuts on the roller 40 with the belt 31 being disposed therebetween. More specifically, the vertical groove portions 35*g* (FIGS. 2 and 3) provided in the left and right terminal members 35L and 35R of the unit 30 are engaged with vertical edge portions of vertical guide slits 51*a* (FIG. 3) provided in the left and right side plates 51L and 51R.

Thus, the left and right terminal members 35L and 35R are held to make slide motion in the up-down direction relative to the left and right side plates 51L and 51R, respectively. That is, the unit 30 is held to make slide motion in the up-down direction relative to the left and right side plates 51L and 51R.

As illustrated in FIG. 2, pressure springs (urging members) 70L and 70R are provided in a compressed manner between the pressure-receiving block portions 35*f* of the left and right terminal members 35L and 35R and spring receiving portions 71 fixedly disposed above the pressure-receiving block portions 35*f*. In a free state, the pressure springs 70L and 70R press the pressure-receiving block portions 35*f* of the terminal members 35L and 35R downward with a predetermined pressing force that is substantially equal between the right and left sides. In the embodiment, the pressing force is 156.8 N (16 kgf) at one end, and the total pressing force is 313.6 N (32 kgf).

Thus, the belt 31 is in pressure contact with the upper surface of the roller 40 with the predetermined pressing force against elasticity of the elastic layer 42 with the stay 33 and the pad 32 being disposed therebetween (a pressed state). For this reason, the nip portion N having a predetermined width is formed in the widthwise direction (sheet conveying direction) between the unit 30 (belt 31) and the roller 40.

The fixing device F further includes pressure release mechanisms 72L and 72R that release the belt 31 from the pressed state against the roller 40 by lifting the left and right terminal members 35L and 35R against the pressing forces of the pressure springs 70L and 70R. Specifically, the pressure release mechanisms 72L and 72R determine the holding positions of the terminal members 35L and 35R by moving lifters 73 according to instructions from the control circuit 100.

When the terminal members 35L and 35R are moved to predetermined lift positions, the unit 30 entirely moves away from the roller 40, and the belt 31 separates from the roller 40 and is held in a pressure release state. When the lifters 73 move down from the pressure release state, the terminal members 35L and 35R are moved down. When the lifters 73 move to predetermined lower positions such as not to act on the terminal members 35L and 35R, a pressed state is brought about again.

While the specific structure of the pressure release mechanisms 72L and 72R is not illustrated, for example, a mechanism using an electromagnetic solenoid or a mechanism using a cam and a motor can be adopted. A common pressure release mechanism can be used for the left and right terminal members 35L and 35R.

In FIG. 2, W31 represents the total width of the belt 31, and W40 represents the width of the roller 40 (excluding the small-diameter shaft portions 41*a*). The width W40 of the roller 40 is smaller than the total width W31 of the belt 31 by a predetermined width. The width of the stay 33 excluding the right and left end portions 33*a* is substantially equal to the width W40 of the roller 40. The length of the pad 32 is substantially equal to the width W40 of the roller 40. The width (in the longitudinal direction) of the nip portion N is equal to the width W40 of the roller 40. In the embodiment, W31 is 320 mm and W40 is 340 mm.

The left and right power feed rings 38L and 38R of the belt 31 are located outside of the end portions of the roller 40 (end portions of the nip portion N) in the longitudinal direction. Here, Wmax represents the sheet conveyance area width (the maximum sheet passage width) of a sheet having the maximum width that can be used in the fixing device F, and is smaller than the width W40 of the nip portion N by a predetermine width. In the embodiment, the width of a heating resistor layer 31*b* of the belt 31 (width of the effective heat generating region of the belt 31) is larger than the sheet conveyance area width Wmax and smaller than the width W40 of the nip portion N.

As illustrated in FIG. 3, the fixing device F includes an upper cover plate 53, a front cover plate 54, an inlet-side guide plate 55, a rear cover plate 56, an outlet-side guide plate 57, and a fixing discharge roller pair 58. The fixing discharge roller pair 58 is rotationally driven in a predetermined direction and at a predetermined peripheral velocity by driving force transmitted from the roller 40 via an interlocking mechanism (not illustrated). The leaf springs 61 serving as conductive elastic support members of the left and right power feed members 60L and 60R are electrically connected to a power feed circuit (AC power supply circuit) 101 by wires 102. The thermistor TH is electrically connected to the control circuit 100 via a wire (not illustrated).

Fixing Operation

In the fixing device F, when the control circuit 100 receives a start signal of a print job, it controls the power feed circuit 101 to start energization of a heating resistor layer 31*b* (hereinafter referred to as a heat generating layer 31*b*) of the belt 31 in a predetermined energization control pattern.

That is, voltage is applied to the left and right power feed rings 38L and 38R via the left and right power feed members 60L and 60R, respectively. Thus, the heat generating layer 31*b* is energized via electrode layers 31*d* (to be described later, FIG. 5) electrically connected to the power feed rings 38L and 38R. Heat generated by the energized heat generating layer 31*b* heats the belt 31 over the entire circumference within the effective heat generating region width.

When the 100 receives electric information about the temperature of the belt 31 from the thermistor TH, it determines the energization control pattern on the basis of the detection temperature of the belt 31. Then, the control circuit 100 conducts phase control/wavenumber control on the power feed circuit 101 according to the determined energization control pattern to supply adequate power to the heating layer 31*b*.

Further, the control circuit 100 starts up the motor M to start rotational driving of the roller 40 serving as the driving rotating member.

The roller 40 rotates at a predetermined peripheral velocity in the counterclockwise direction of arrow R40 in FIG. 3. When the roller 40 is rotationally driven, rotation torque is applied to the belt 31 by frictional force in the nip portion N between the roller 40 and the outer surface of the belt 31. Thus, the belt 31 is driven in the direction of arrow R31 (clockwise direction, FIG. 3) at a peripheral velocity substantially corresponding to the rotation peripheral velocity of the roller 40.

While the rotating belt 31 laterally deviates to the left or the right along the length of the pad 32, this deviation is limited to a predetermined range by the flange portions 35*a* of the left and right terminal members 35L and 35R. Specifically, the flange portions 35*a* of the left and right terminal members 35L and 35R receive movements of the power feed rings 38L and 38R that rotate together with the belt 31. The guide portions 35*c* guide the inner peripheral surfaces of the power feed rings 38L and 38R that rotate together with the belt 31. After that, the control circuit 100 starts an image forming operation of the image forming section 10 when the thermistor TH detects a second predetermined temperature (job start temperature) higher than a first predetermined temperature (waiting temperature). Then, a sheet P on which a toner image t is transferred is conveyed to the fixing device F. In contrast, the control circuit 100 changes the energization state of the heat generating layer 31*b* of the belt 31 to a temperature maintaining state when the thermistor TH detects a third predetermined temperature (fixing temperature) higher than the second predetermined temperature. In the temperature maintaining state, the power feed circuit 101 conducts energization control on the heat generating layer 31*b* by using, for example, PI control so that the temperature of the belt 31 is kept substantially fixed at the third predetermined temperature serving as the fixing temperature.

When the sheet P on which the toner image t is transferred is conveyed to the fixing device F, it enters the nip portion N along the inlet-side guide plate 55 and is nipped and conveyed. Thus, the toner image t and the sheet P are heated and pressed, and the toner image t is fixed as a fixed image on the sheet P. While the method for introducing the sheet P to the fixing device F is a so-called center reference conveyance method with reference to the sheet widthwise center in the embodiment, the method is not limited thereto, and a so-called one-side reference conveyance method may be used. After coming out from the nip portion N, the sheet P separates from the belt 31, is guided by the outlet-side guide plate 57, enters a nip of the fixing discharge roller pair 58, and is conveyed and discharged.

When a print job for predetermined one or plural successive sheets is completed, the control circuit 100 stops energization of the heat generating layer 31*b* of the belt 31. Further, the control circuit 100 stops driving of the motor M. In this state, the control circuit 100 keeps the fixing device F in a waiting state until a start signal for the next print job is input.

Structure of Belt

Figure 5A:
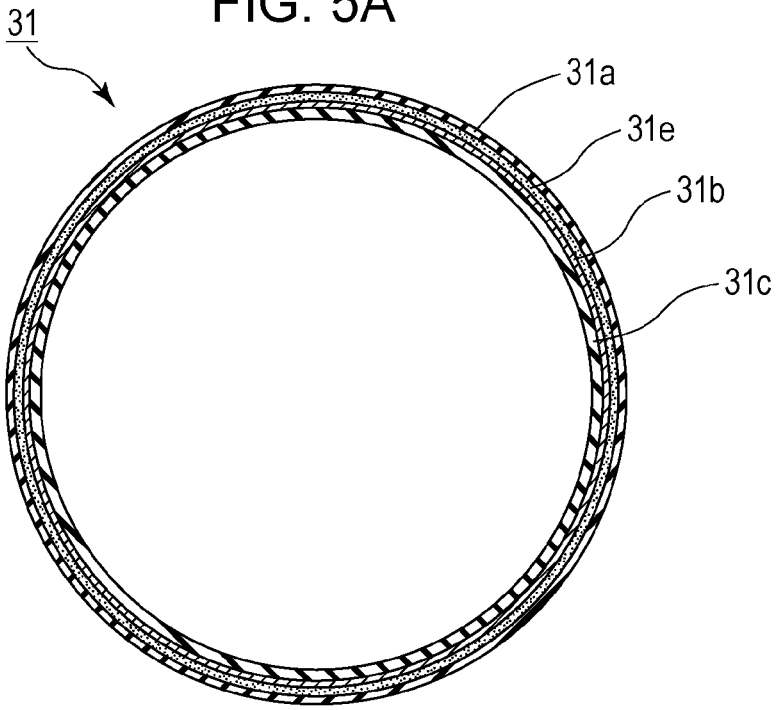
FIGS. 5A and 5B illustrate the layer structure of a belt in the embodiment.
Figure 5B:
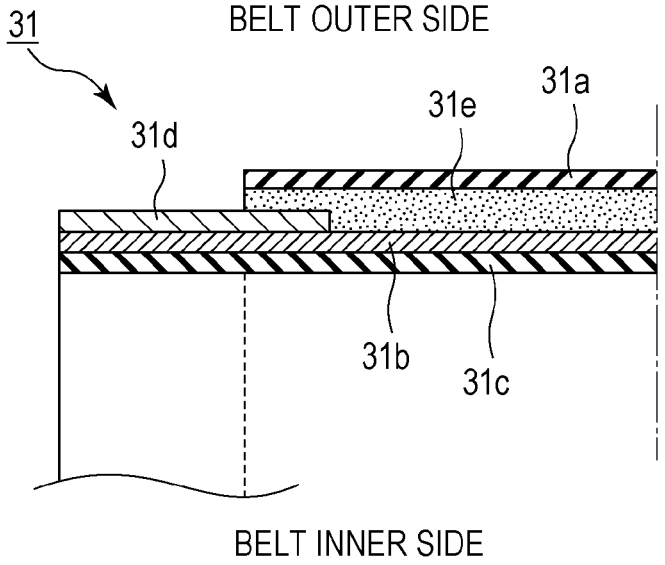

FIG. 5A is a schematic cross-sectional view of a heat generating region of the belt 31. FIG. 5B is a schematic cross-sectional view illustrating the layer structure of a left end portion of the belt 31. Since the belt 31 is symmetrically structured in the longitudinal direction, the layer structure of a right end portion of the belt 31 is similar to that of FIG. 5B.

The belt 31 is an endless member (endless belt) that is entirely flexible. The belt 31 has a width larger than that of the roller 40 so that the power feed rings 38 can be attached to both longitudinal end portions thereof. As illustrated in FIGS. 5A and 5B, the belt 31 has a three-layer composite structure in which at least an insulating layer 31*a*, a heat generating layer 31*b* for generating heat by power feeding, and a cylindrical insulating base material 31*c* (hereinafter referred to as a base material 31*c*) are stacked in this order from the outer side to the inner side. In the embodiment, an elastic layer 31*e* is provided between the insulating layer 31*a* and the heat generating layer 31*b* in order to improve fixability. Electrode layers 31*d* serving as conductive layers are provided along the entire circumferences of outer surfaces of both longitudinal end portions of the heat generating layer 31*b*. In the embodiment, the electrode layers 31*d* are provided in areas of 15 mm in the longitudinal end portions of the belt 31.

The base material 31*c* is a member that maintains strength of the belt 31, has flexibility to be deformable in the circumferential direction, and has an insulating property. As the material of the base material 31*c*, for example, a belt formed of resin, such as polyimide, polyamide imide, PEEK (polyetheretherketone), PTFE (polytetrafluoroethylene), PFA (perfluoroalkoxyalkane), or FEP (a tetrafluoroetylene-hexafluoropropylen copolymer), or a belt formed of metal, such as SUS or nickel, can be used. However, when the base material 31*c* is too thin, belt breakage is likely to occur. When the base material 31*c* is too thick, the belt 31 is hard to deform. Hence, a heat-resistant resin material, such as polyimide, is used with a thickness within the range of 20 to 100 μm. In the embodiment, a cylindrical polyimide belt having a thickness of 50 μm and a diameter of 30 mm is used.

The elastic layer 31*e* allows the belt 31 to easily follow unevenness of the sheet P to improve fixability. To reduce the heat capacity for higher quick startability, the elastic layer 31*e* is formed of a silicone rubber material or a fluororubber material having a thickness of 400 μm or less and having high heat conductivity.

The heat generating layer 31*b* is provided on the outer peripheral surface of the base material 31*c* to generate heat by energization. For example, the heat generating layer 31*b* can be formed of a material in which conductive carbon or metal powder is dispersed in a heat-resistant resin such as polyimide. In the embodiment, a coat layer formed of a heating resistor made of polyimide containing dispersed carbon and having a thickness of 25 μm is used. The dispersion amount of carbon is adjusted so that the resistance value between the right and left electrode layers 31*d* in both end portions of the belt 31 becomes 10Ω at ordinary temperature. Thus, the heat generating layer 31*b* is caused by a power of about 1000 W to generate heat when a voltage of 100 V is applied.

The insulating layer 31*a* is provided on the entire heat generating layer 31*b* and parts of the electrode layers 31*d* on the side of the heat generating layer 31*b* to prevent current from flowing to portions other than the belt 31 and to avoid soiling due to toner adhesion. The insulating layer 31*a* is required to have releasability from toner. Since the insulating layer 31*a* is in contact with the electrode layers 31*d* and the heat generating layer 31*b*, it is also required to have an insulating property so that current does not flow therethrough. Hence, the insulating layer 31*a* can be formed of a fluoroplastic material having the insulating property such as PFA or PTFE.

When the insulating layer 31*a* is too thin, the life thereof is reduced by wear due to friction with the sheet P and the roller 40. When the insulating layer 31*a* is too thick, the heat capacity increases and heat conductivity decreases. This may hinder energy saving. For this reason, the insulating layer 31*a* can be formed of a fluoroplastic material having a thickness of 10 to 50 μm. In the embodiment, an insulating PFA resin tube having a thickness of 20 μm is used.

The electrode layers 31*d* allow uniform energization of the heat generating layer 31*b* over the entire circumference. The resistivity of the electrode layers 31*d* is sufficiently lower than that of the heat generating layer 31*b*. In the embodiment, the electrode layers 31*d* are formed of a material containing silver and palladium and having conductivity.

The electrode layers 31*d* do not always need to be provided as long as adhesiveness between the power feed rings 38 and the belt 31 is high and energization unevenness is suppressed.

While the electrode layers 31*d* are provided on the heat generating layer 31*b* in the embodiment, the structure of the belt 31 is not limited thereto. For example, the heat generating layer 31*b* and the electrode layers 31*d* may be juxtaposed on the base material 31*c*.

Power Feed Rings

Figure 6A:
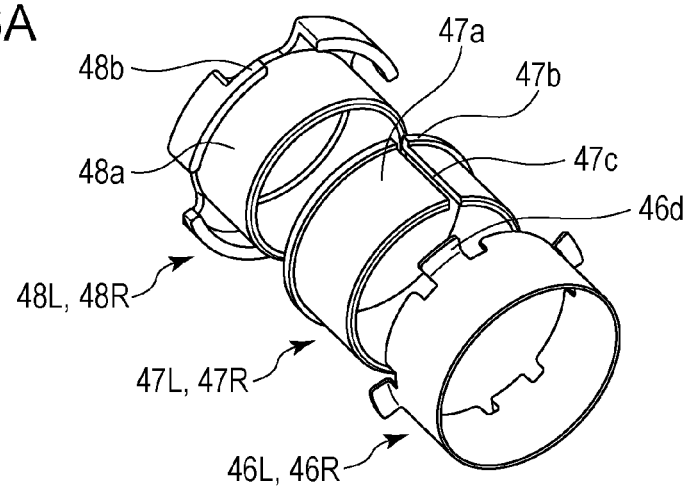
FIGS. 6A to 6C illustrate the structure of a power feed ring in the embodiment.
Figure 6B:
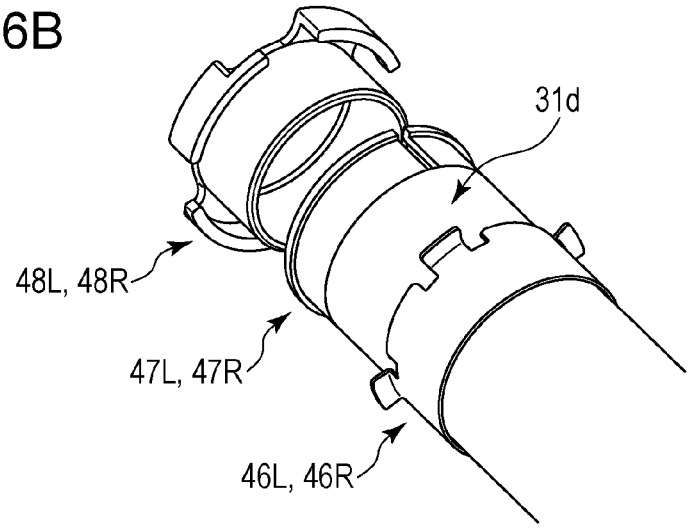
Figure 6C:
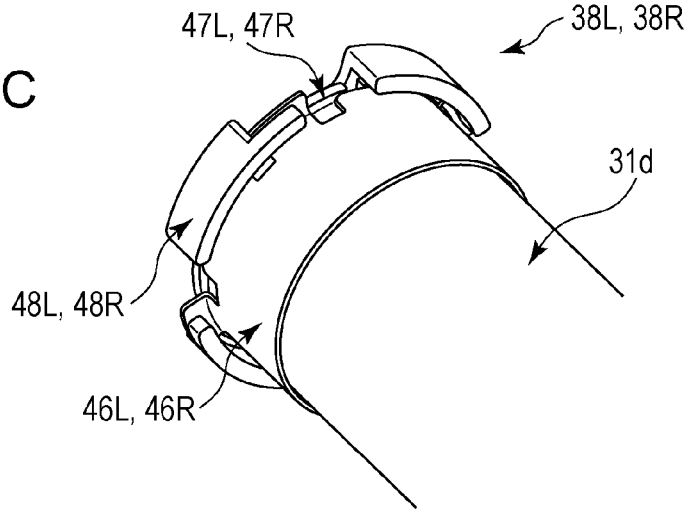
Figure 7:
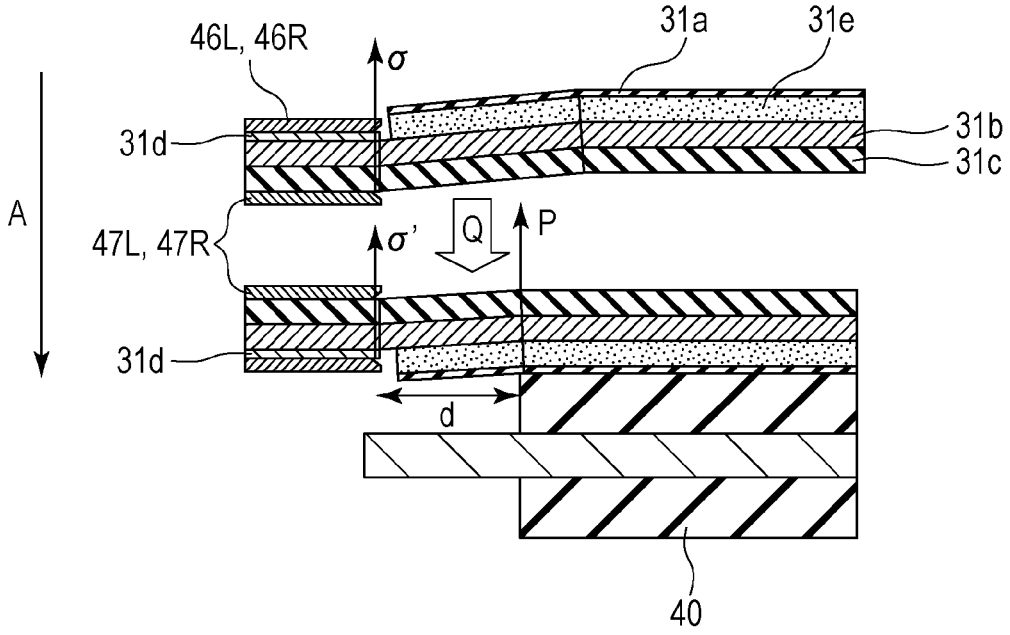
FIG. 7 is a partial sectional view of the fixing device in the embodiment.

Next, the structure of the power feed rings 38L and 38R will be described in detail. FIGS. 6A to 6C illustrate the structure of the power feed ring 38L in the embodiment. FIG. 7 is a partial sectional view of the fixing device F in the embodiment.

The fixing device F of the embodiment has a symmetrical structure in which the power feed ring 38L is provided in one longitudinal end portion of the belt 31 and the power feed ring 38R is provided in the other longitudinal end portion. For this reason, in the following description, the power feed ring 38L is given as an example. The power feed ring 38L includes an outer ring 46L serving as a ring-shaped member, an inner ring 47L serving as a ring-shaped member, and a fixing ring 48L (48R) serving as a fixing member (ring-shaped holding member). The power feed ring 38R includes an outer ring 46R serving as a ring-shaped member, an inner ring 47R serving as a ring-shaped member, and a fixing ring 48R serving as another fixing member (ring-shaped holding member). Hereinafter, the power feed ring 38L and the power feed ring 38R are generically referred to as a power feed ring 38. The outer ring 46L and the outer ring 46R are generically referred to as an outer ring 46. The inner ring 47L and the inner ring 47R are generically referred to as an inner ring 47. The fixing ring 48L and the fixing ring 48R are generically referred to as a fixing ring 48. The power feed member 60L and the power feed member 60R are generically referred to as a power feed member 60.

The power feed ring 38 is joined to the end portion of the belt 31 by combining the above-described members, and functions as an electrode portion that can rotate integrally with the belt 31. Since the power feed ring 38 is hard to warp, it has a good abutting state on the fixing unit 60 even in a rotating state. That is, although the method of the related art in which the power feed member directly abuts on the electrode layer of the belt 31 without using the power feed ring 38 has the problem in that the electrode vibrates and causes conduction failure between the electrode and the power feed member, the embodiment overcomes this problem. Further, in the embodiment, the power feed member 60 does not directly abut on the electrode layer 31*d*, unlike the method of the related art. For this reason, it is possible to prevent the surface of the electrode layer from wearing and peeling off and to extend the life of the belt 31.

Further, in the embodiment, a corner portion 47*e* of the inner ring 47 where stress is particularly likely to concentrate is chamfered to suppress stress concentration caused in a portion of the belt 31 abutting on the end portion of the power feed ring 38. By thus making the angle of the corner portion 47*e* to the surface of the belt 31 gentle (obtuse), the abutment pressure of the belt 31 on the corner portion 47*e* of the inner ring 47 can be reduced. For this reason, in the fixing device F of the embodiment, the above-described stress concentration is suppressed. This will be described in detail below with reference to the drawings.

The outer ring 46 is a conductive member fitted on and electrically connected to the annular electrode layer 31*d* on the outer peripheral side of the end portion of the belt 31. In the embodiment, the outer ring 46 is a ring-shaped member formed by subjecting a copper plate having a thickness of 1 mm to press working. Further, protrusions 46*d* are provided in one end portion of the outer ring 46. The outer ring 46 slidably abuts on the power feed member 60 for electrical connection.

For this reason, the outer ring 46 has a width (region) that allows the power feed member 60 to stably abut thereon. That is, the width of the outer ring 46 is larger than the width of the power feed member 60. In the embodiment, since the width of the power feed member 60 is 3 mm, the width of the outer ring 46 is set at 5 mm.

The inner ring 47 is a member opposed to the outer ring 46 with the belt 31 being disposed therebetween. In the embodiment, the inner ring 47 is a ring-shaped member formed by subjecting a copper plate having a thickness of 1 mm to press working. The inner ring 47 has an annular portion 47*a* inserted in an inner peripheral side of the end portion of the belt 31, a flange portion 47*b* having a diameter larger than the diameter of the belt 31, and a slit 47*c* provided in the axial direction. The inner ring 47 has a width of 3 mm or more to reliably clamp the belt 31 in cooperation with the outer ring 46. In the embodiment, the width of the inner ring 47 is 5 mm.

The fixing ring 48 is a ring-shaped member that fixes the inner ring 47 and the outer ring 46 to each other. The fixing ring 48 has an annular portion 48*a* tapered to be inserted in the inner surface of the inner ring 47, and a projection 48*b* provided at its end. In the embodiment, the fixing ring 48 is provided out of contact with the belt 31. Further, in the embodiment, a gradient of about 3 degrees is provided as taper in the annular portion 48*a* of the fixing ring 48. Still further, in the embodiment, PPS resin (polyphenylenesulfide resin) having high heat resistance is used as the material of the fixing ring 48.

The outer ring 46 and the inner ring 47 are disposed to clamp front and back sides of the end portion of the belt 31, and are fixed by the fixing ring 48 to form the power feed ring 38.

Specifically, when the fixing ring 48 is inserted in the outer ring 46 and the inner ring 47 that clamp the end portion of the belt 31, the inner ring 47 is deformed to spread outward in the radial direction by the taper of the annular portion 48*a* of the fixing ring 48. Then, the outer ring 46 and the inner ring 47 are brought into tight contact with the front and back sides of the end portion of the belt 31.

Further, the outer ring 46 is fixed at the position of the longitudinal end portion of the belt 31 by engagement of the protrusions 46*d* with the projection 48*b* of the fixing ring 48. The inner ring 47 is fixed at the position of the longitudinal end portion of the belt 31 with the flange portion 47*b* being clamped between the fixing ring 48 and the outer ring 46. As a result, the outer ring 46 and the electrode layer 31*d* in the end portion of the belt 31 are reliably joined and electrically connected. That is, the fixing ring 48 holds the outer end portion of the outer ring 46 and the outer end portion of the inner ring 47 in the longitudinal direction of the belt 31, and fixes the outer ring 46 and the inner ring 47 integrally. Therefore, the inner ring 47 and the outer ring 46 are allowed by the fixing ring 48 to be rotatable integrally with the belt 31.

While the inner ring 47 and the outer ring 46 are fixed by the fixing ring 48 in the embodiment, the fixing method is not limited only thereto. For example, holes may be formed in corresponding positions of the inner ring 47 and the outer ring 46, and the inner ring 47 and the outer ring 46 may be fixed by being fastened with, for example, a screw.

Here, a description will be given of stress caused in the belt 31 by the relationship among the outer ring 46, the inner ring 47, and the roller 40 with reference to FIG. 7. In the fixing device F of the embodiment, the power feed rings 38 are attached to both end portions of the belt 31. For this reason, the fixing device F is designed so that the belt 31 is longer than the roller 40 in the longitudinal direction. Each of the terminal members 35 for transmitting the pressing force of the pressure-receiving block portion 35*f* to the stay 33 has the guide portion 35*c* that guides the inner ring 47 by being fitted in the inner ring 47. For this reason, each of the power feed rings 38 is pressed from the terminal member 35 in the direction of arrow A, for example, by a minute warp of the stay 33. On the other hand, a pressing roller resistive force of arrow P occurs against the pressing force of the unit 30 on the end surface of the roller 40. For this reason, the belt 31 deforms in a direction of arrow Q between the power feed ring 38 and the roller 40. A region d where the belt 31 deforms is an area of 5 mm between the end portion of the roller 40 and the end portion of the power feed ring 38. It is confirmed that the belt surface in this region is at an angle of about 1° to the belt surface clamped by the power feed ring 38. As described above, the electrode layer 31*d* provided in the end portion of the belt 31 and the outer ring 46 and the inner ring 47 for protecting the electrode layer 31*d* are formed of metallic materials having a rigidity higher than that of the belt 31. For this reason, as illustrated in FIG. 7, by deformation of the belt 31 in the direction of arrow Q, a stress a' is caused in the contact end portion between the outer ring 46 and the electrode layer 31*d* and a stress a is caused in the contact end portion between the inner ring 47 and the base material 31*c*. These stresses a and a' are caused at the boundary between the relatively flexible belt 31 and the power feed ring 38 formed of metal. In particular, since the deformation amount of the belt 31 is large on the lower side (nip portion N side), the belt 31 strongly abuts on the corner portion of the inner ring 47. For this reason, if the belt 31 is continuously rotated with this structure, it may be worn and damaged by the inner ring 47. Particular when the heat generating layer 31*b* is damaged, energization failure occurs to the belt 31.

Figure 8A:
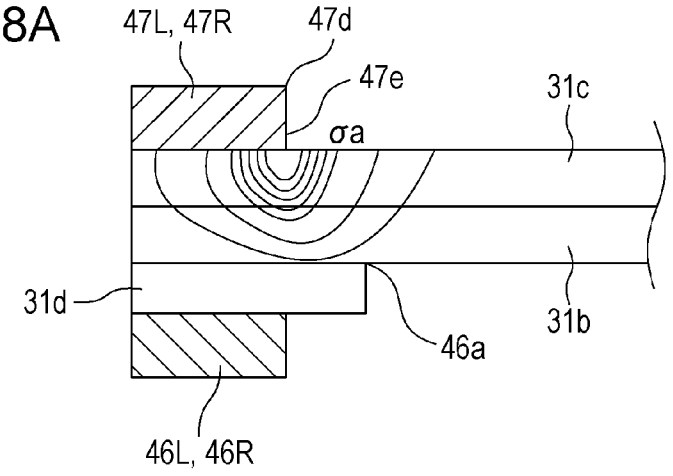
FIG. 8A illustrates stress concentration in a belt according to a comparative example.
Figure 8B:
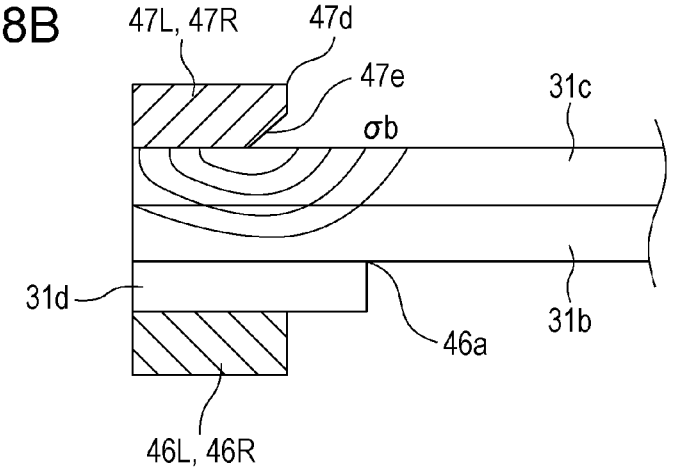
FIG. 8B illustrates stress concentration in a belt according to a modification.
Figure 8C:
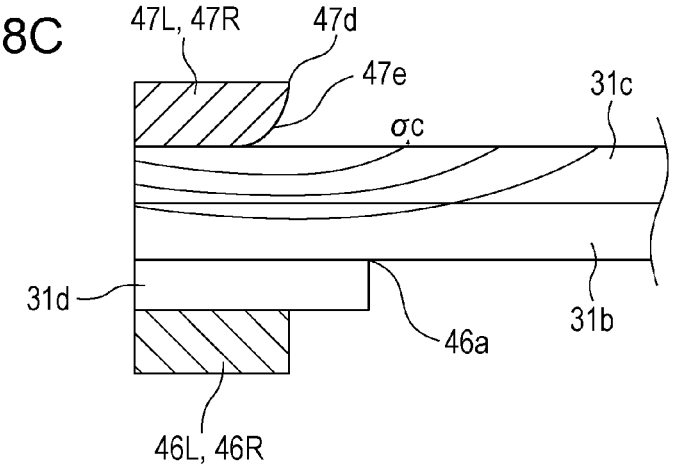
FIG. 8C illustrates stress concentration in the belt of the embodiment.

To overcome the above-described problem, in the embodiment, a predetermined corner portion of the inner ring 47 is chamfered. FIG. 8A illustrates stress concentration in a belt 31 of a comparative example. FIG. 8B illustrates stress concentration in a belt 31 of a modification. FIG. 8C illustrates stress concentration in the belt 31 of the embodiment.

In the embodiment, as illustrated in FIG. 8C, an end portion on the longitudinal center side of the surface of the inner ring 47 abutting on the inner surface of the belt 31 is chamfered. This chamfered portion is referred to as a corner portion 47*e*.

In the embodiment, the corner portion 47*e* is rounded by R-chamfering (corner rounding, round chamfering). This relaxes stress concentration in the belt 31, and the curvature radius of R-chamfering is as large as possible. On the other hand, when safety at the time of assembly of the power feed ring 38 is considered, it is conceivable to also chamfer a corner portion other than the corner portion 47*e* (for example, a corner portion 47*d*). It is only necessary that the corner portion 47*d* should be chamfered to an extent such as to prevent a wound in the human finger and that the curvature radius should be about 0.2 mm. In contrast, the curvature radius of the corner portion 47*e* is larger than that of the corner portion 47*d*. Specifically, when the corner portion 47*d* is R-chamfered, the curvature radius of the corner portion 47*e* is larger than the curvature radius of the corner portion 47*d*. When the corner portion 47*d* is C-chamfered, the chamfering length of the corner portion 47*e* is larger than the chamfering length of the corner portion 47*d*.

To make a significant difference from chamfering of the corner portion 47*d*, the curvature radius of the corner portion 47*e* is larger than a half of the thickness of the inner ring 47 (0.5 mm in the embodiment). In such a structure, it can be said that the curvature radius of the corner portion 47*e* is certainly larger than the dimension of the corner portion 47*d*. The entire end portion on the longitudinal center side of the inner ring 47, of the surface of the inner ring 47 abutting on the inner surface of the belt 31, is curved. That is, the curvature radius of the corner portion 47*e* is larger than or equal to the thickness (1 mm in the embodiment) of the inner ring 47. Accordingly, a curvature radius R of the corner portion 47*e* is set at 1 mm in the embodiment.

Figure 9:
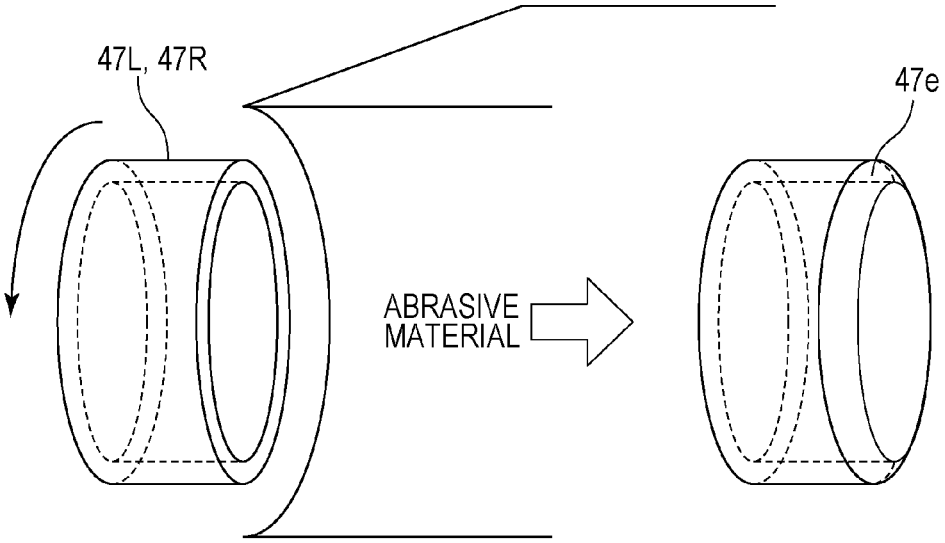
FIG. 9 illustrates a chamfering method for an inner ring.

Next, a description will be given of an example of an R-chamfering method for the inner ring 47. FIG. 9 illustrates a chamfering method for the inner ring 47. The outer peripheral side of the inner ring 47 abuts on the belt 31. For this reason, one end portion (corner portion 47*e*) of the inner ring 47 on the outer peripheral side is subjected to chamfering. As illustrated in FIG. 9, an abrasive material shaped like an inverted crown is used for chamfering. By rotating the inner ring 47 with its end surface being pressed against the abrasive material, the corner portion 47*e* is chamfered over its entire circumference.

While R-chamfering is performed as chamfering for the corner portion 47*e* in the above description, chamfering is not limited only thereto. For example, chamfering may be C-chamfering. In this case, the curvature radius described above is replaced with the chamfering length. Here, the curvature radius and the chamfering length are generically referred to as a chamfering dimension. While chamfering is generally performed at 45° with respect to the outer surface of the inner ring 47 in C-chamfering, the present invention is not limited thereto. For example, the angle of C-chamfering may be adjusted within the range of 30° to 60°. This can make the angle of the corner portion 47*e* obtuse and can suppress stress concentration in the belt 31. However, the corner portion 47*e* is R-chamfered as in the embodiment because R-chamfering can more effectively relax stress concentration.

As described above, the stress a' also occurs in the contact end portion between the outer ring 46 and the electrode layer 31*d*.

Since the roller 40 abuts on the lower side of the belt 31, deformation of the belt 31 is gentle on the upper side. For this reason, although the stress a' is lower than the stress a, it may cause damage to the belt 31.

Accordingly, a corner portion 46*a* (FIG. 8C) serving as an end portion of the inner peripheral surface of the outer ring 46 on the side of the longitudinal center side of the belt 31 may be subjected to chamfering (R-chamfering or C-chamfering) similarly to the corner portion 47*e*.

Figure 10:
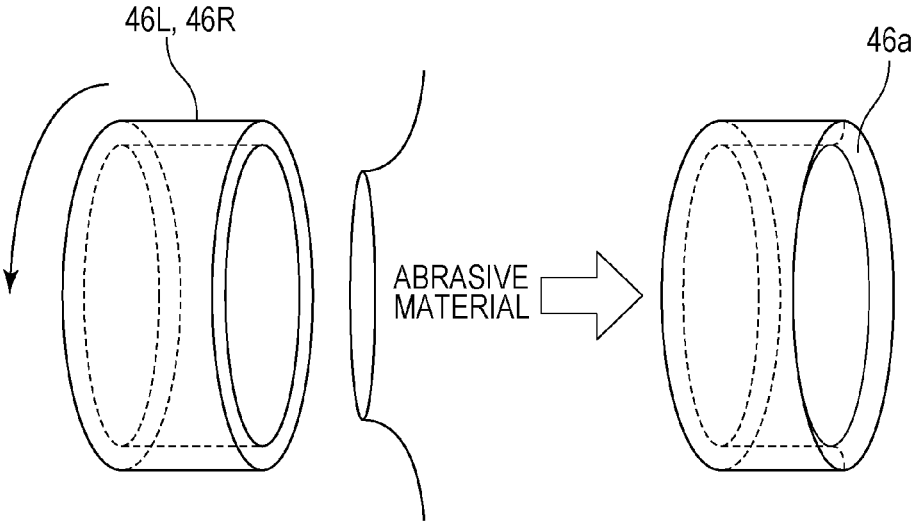
FIG. 10 illustrates a chamfering method for an outer ring.
Figure 11A:
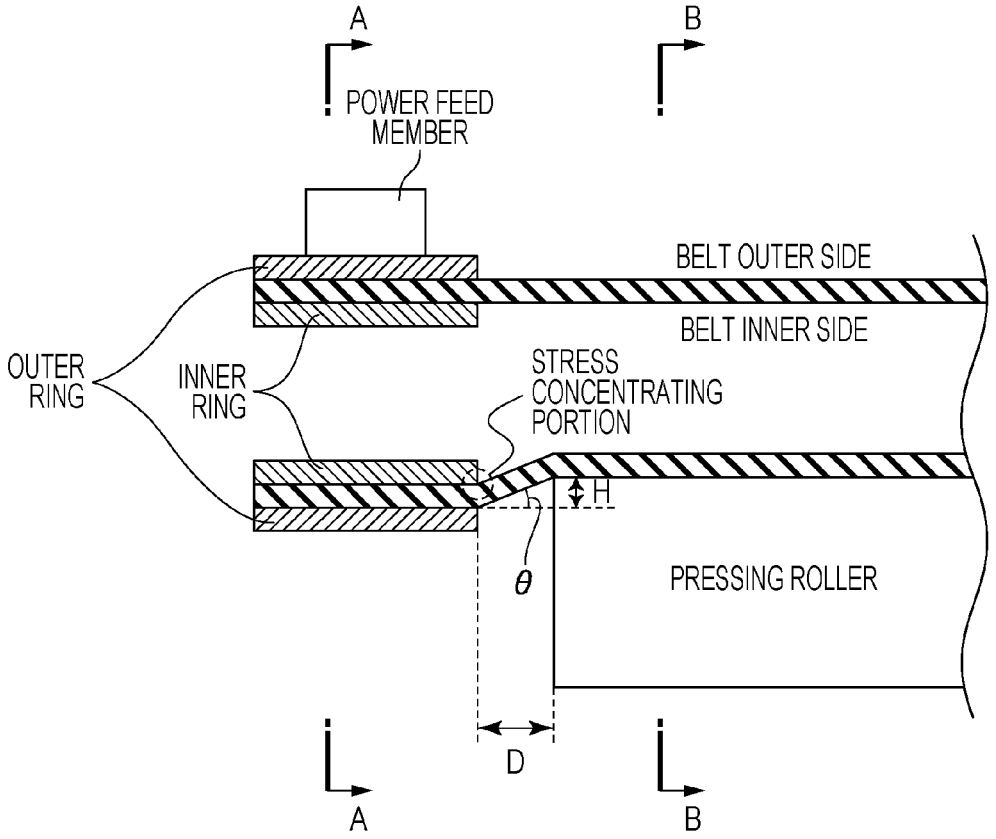
FIGS. 11A and 11B are schematic partial views of a fixing device when a belt having a power feed ring in its end portion is pressed against a pressing roller.
Figure 11B:
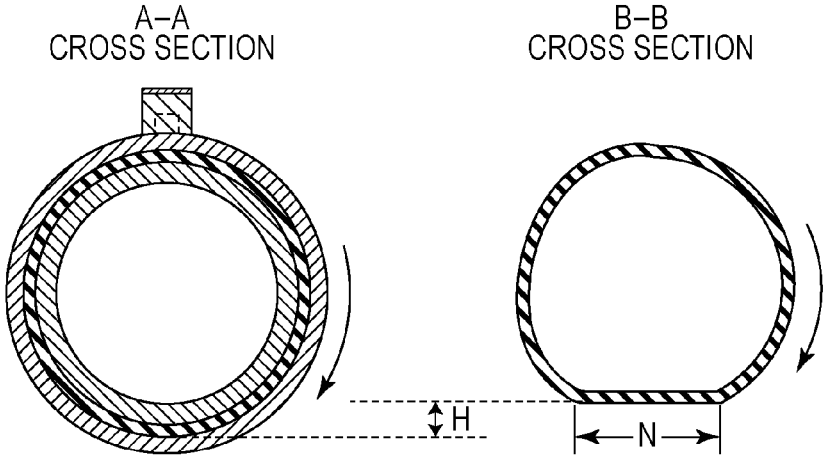

A description will be given of an example of a chamfering method for the outer ring 46 in this case. FIG. 10 illustrates a chamfering method for the outer ring 46. The inner peripheral side of the outer ring 46 abuts on the belt 31. For this reason, one end portion (corner portion 46*a*) of the inner peripheral surface of the outer ring 46 is subjected to chamfering. As illustrated in FIG. 10, an abrasive material projecting like a peak is used for chamfering. The corner portion 46*a* is chamfered over the entire circumference by rotating the outer ring 46 with its end surface being pressed against the abrasive material.

Since stress concentrates at the belt 31 even in the portion abutting on the end portion of the roller 40, the end portion of the roller 40 may be chamfered. However, since the roller 40 is formed of a highly flexible material, stress concentration is not so large. Therefore, the priority order of chamfering is the order of the inner ring 47, the outer ring 46, and the roller 40.

Advantageous Effects of Embodiment

Advantageous effects of the above-described embodiment will be described in detail. As illustrated in FIG. 8A, it can be confirmed in the comparative example that the stress distribution of the heat generating layer 31*b* with respect to the corner portion 47*d* of the inner ring 47 is dense because the inner ring 47 is not chamfered. In contrast, in the modification in which the corner portion 47*d* of the inner ring 47 is subjected to C-chamfering, as illustrated in FIG. 8B, the density of the stress distribution is lower than in FIG. 8A and the effect of relaxing the stress can be confirmed. However, even when C-chamfering is performed, as illustrated in FIG. 8B, the inner ring 47 has an obtuse projecting portion at the corner portion 47*d*. For this reason, some stress concentration occurs in a portion of the heat generating layer 31*b* opposed to the projecting portion. FIG. 8C illustrates the embodiment in which the corner portion 47*d* of the inner ring 47 is subjected to R-chamfering. As illustrated in FIG. 8C, the density of the stress distribution of the heat generating layer 31*b* with respect to the corner portion 47*d* of the inner ring 47 is even lower than in FIG. 8B, and a further effect of relaxing stress can be confirmed.

An endurance test for the belt 31 was conducted on fixing devices F using the inner rings 47 of the comparative example, the modification, and the embodiment described above. Table shows the number of successive sheets P processed in the fixing device F until the belt 31 ruptured in the circumferential direction in the endurance test.

TABLE

| Number of Successive Sheets P Processed Until Circumferential Rupture of Fixing Belt | | | |
|---|---|---|---|
| | A Comparative Example | B Modification | C Embodiment |
| Number of Successive Sheets Processed Until | 100K | 150K | 200K |

TABLE-continued

| Number of Successive Sheets P Processed Until Circumferential Rupture of Fixing Belt | | | |
|---|---|---|---|
| | A Comparative Example | B Modification | C Embodiment |
| Circumferential Rupture of Fixing Belt in (Number of Sheets) | | | |

Table shows that the number of successive sheets P processed until the belt 31 ruptures increases in the order of the comparative example, the modification, and the embodiment. That is, it is confirmed that the endurance number of sheets until circumferential rupture of the belt 31 occurs can be made larger in the embodiment and the modification than in the comparative example.

According to the above-described embodiment, stress concentration of the belt 31 with respect to the outer ring 46 can be relaxed, and damage to the belt 31 can be suppressed. In particular, the life of the belt 31 can be extended by suppressing circumferential rupture of the heat generating layer 31*b* and the electrode layer 31*d* in the belt 31.

Other Embodiments

While the embodiment to which the present invention can be applied has been described above, the numerical values, such as dimensions, adopted in the embodiment are just exemplary, and numerical values are not limited thereto. The numerical values can be appropriately selected within the range of application of the present invention. Further, the structures adopted in the embodiment may be appropriately changed within the range of application of the present invention.

The abutting manner of the power feed member 60 on the power feed ring 38 is not limited to abutment on the outer peripheral surface of the outer ring 46. For example, the power feed member 60 may be disposed to abut on the inner peripheral surface of the inner ring 47. In this case, the inner ring 47 is formed by a conductive member. In both longitudinal end portions of the belt 31, an electrode layer connected to the lower surface of the heat generating layer 31*b* (FIG. 5) may be provided instead of the base material 31*c*. The above-described structure allows the heat generating layer 31*b* and the inner ring 47 to be connected stably and electrically.

The structure of the belt 31 is not limited to the one in which the belt 31 is supported on the inner surface by the pad 32 and is driven by the roller 40. For example, the belt 31 may be a belt unit that is stretched on a plurality of rollers and is driven by any of the rollers. However, the structure of the embodiment is adopted from the viewpoint of low heat capacity.

The nip forming member is not limited to the roller member like the roller 40. For example, a pressing belt unit in which a belt is stretched on a plurality of rollers may be used.

The image forming apparatus described by using the printer 1 as the example is not limited to the image forming apparatus that forms a full-color image, and may be an image forming apparatus that forms a monochromatic image. The image forming apparatus can be carried out in various applications, such as a copying machine, a facsimile, and a multi-function apparatus having some of functions of these machines, by adding necessary devices, elements, and casing structures.

The above-described fixing device is not limited only to the one that fixes an unfixed toner image on a sheet P. For example, the fixing device may fix a semi-fixed toner image on a sheet P or may heat a fixed image. Therefore, for example, the fixing device may be used as a surface heating device that adjusts the gloss and surface property of the image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-206645, filed Oct. 7, 2014 and No. 2014-211196 filed Oct. 15, 2014 which are hereby incorporated by reference herein in their entirety.

What is claimed is:

1. An image heating apparatus comprising:

an endless and flexible belt configured to heat an image on a sheet, and having a heat generating layer configured to generate heat by energization;

an abutting member configured to abut on an outer peripheral surface of the belt so that a nip portion is formed between the belt and the abutting member to nip and convey the sheet;

a pressing mechanism configured to press the belt and the abutting member against each other;

a first ring-shaped member provided along the outer peripheral surface of the belt at one end of the belt on an outer side of the nip portion in a longitudinal direction of the belt, the first ring-shaped member being electrically connected to the heat generating layer;

a second ring-shaped member provided along an inner peripheral surface of the belt at the one end of the belt on the outer side of the nip portion in the longitudinal direction, the second ring-shaped member clamping the belt along with the first ring-shaped member; and a power feed member configured to abut on the first ring-shaped member to feed power to the first ring-shaped member, wherein the second ring-shaped member has a chamfered portion chamfered on a surface abutting on the belt and in an end portion on a side of the nip portion in the longitudinal direction of the belt.

2. The image heating apparatus according to claim 1, wherein the chamfered portion is subjected to R-chamfering.

3. The image heating apparatus according to claim 2, wherein the second ring-shaped member has a further chamfered portion R-chamfered on a surface that does not abut on the belt and in the end portion on the side of the nip portion in the longitudinal direction, and a curvature radius of the chamfered portion is larger than a curvature radius of the further chamfered portion.

4. The image heating apparatus according to claim 2, wherein the second ring-shaped member has a further chamfered portion C-chamfered on a surface that does not abut on the belt and in the end portion on the side of the nip portion in the longitudinal direction, and a curvature radius of the chamfered portion is larger than a chamfering length of the further chamfered portion.

5. The image heating apparatus according to claim 2, wherein a curvature radius of the chamfered portion is larger than a half of a thickness of the second ring-shaped member.

6. The image heating apparatus according to claim 1, wherein the chamfered portion is subjected to C-chamfering.

7. The image heating apparatus according to claim 6, wherein the second ring-shaped member has a further chamfered portion R-chamfered on a surface that does not abut on the belt and in the end portion on the side of the nip portion in the longitudinal direction, and a chamfering length of the chamfered portion is larger than a curvature radius of the further chamfered portion.

8. The image heating apparatus according to claim 6, wherein the second ring-shaped member has a further chamfered portion C-chamfered on a surface that does not abut on the belt and in the end portion on the side of the nip portion in the longitudinal direction, and a chamfering length of the chamfered portion is larger than a chamfering length of the further chamfered portion.

9. The image heating apparatus according to claim 6, wherein a chamfering length of the chamfered portion is larger than a half of a thickness of the second ring-shaped member.

10. The image heating apparatus according to claim 1, wherein the first ring-shaped member has a further chamfered portion chamfered on a surface abutting on the belt and in an end portion on the side of the nip portion in the longitudinal direction.

11. The image heating apparatus according to claim 1, further comprising:

a fixing member configured to fix the first ring-shaped member and the second ring-shaped member to each other so that the first ring-shaped member and the second ring-shaped member rotate integrally.

12. The image heating apparatus according to claim 1, further comprising:

an electrode layer electrically connected to the heat generating layer and abutting on the first ring-shaped member, the electrode layer having an electric resistivity lower than an electric resistivity of the heat generating layer.

13. The image heating apparatus according to claim 1, further comprising:

a third ring-shaped member provided along the outer peripheral surface of the belt at the other end of the belt on an outer side of the nip portion in the longitudinal direction of the belt, the third ring-shaped member being electrically connected to the heat generating layer;

a fourth ring-shaped member provided along an inner peripheral surface of the belt at the other end of the belt on the outer side of the nip portion in the longitudinal direction, the fourth ring-shaped member clamping the belt along with the third ring-shaped member; and a further power feed member configured to abut on the third ring-shaped member to feed power to the third ring-shaped member, wherein the fourth ring-shaped member has a further chamfered portion chamfered on a surface abutting on the belt and in an end portion on the side of the nip portion in the longitudinal direction of the belt.

14. The image heating apparatus according to claim 1, wherein the nip forming member is a driving rotating member configured to rotationally drive the belt.

* * * * *